US007020425B2

(12) United States Patent
Wu et al.

(10) Patent No.: US 7,020,425 B2
(45) Date of Patent: Mar. 28, 2006

(54) HIGH EFFICIENCY HEAT EXCHANGE APPARATUS AND SYSTEM FOR USE WITH A FUSER BELT

(75) Inventors: Fangsheng Wu, Rochester, NY (US); Muhammed Aslam, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 9 days.

(21) Appl. No.: 10/922,043

(22) Filed: Aug. 19, 2004

(65) Prior Publication Data

US 2006/0039725 A1 Feb. 23, 2006

(51) Int. Cl.
*G03G 15/20* (2006.01)

(52) U.S. Cl. ..... 399/329; 399/341

(58) Field of Classification Search ..... 219/216; 399/92, 94, 328, 329, 324, 341, 406
See application file for complete search history.

(56) References Cited

U.S. PATENT DOCUMENTS 6,771,926 B1 * 8/2004 Ishikawa et al. ..... 399/329

* cited by examiner

*Primary Examiner*—Hoang Ngo

(57) ABSTRACT

An improved apparatus for cooling or heating, or both, a fuser belt in a process for producing electrophotographic toner images on a substrate. The images are produced by passing a substrate bearing an image through a fusing zone to fuse fusible toner particles comprising the image to produce a substrate bearing a fused toner image, passing the substrate bearing the fused toner image through a cooling zone to produce a cooled substrate, which is thereafter passed to a release zone where it is released to produce the substrate bearing the toner image.

21 Claims, 5 Drawing Sheets

HIGH EFFICIENCY HEAT EXCHANGE APPARATUS AND SYSTEM FOR USE WITH A FUSER BELT

FIELD OF THE INVENTION

This invention relates to improved apparatus for cooling a fuser belt in a process for producing electrophotographic toner images on a substrate. The images are produced by passing a substrate bearing an image through a fusing zone to fuse fusible toner particles comprising an image to produce a substrate bearing a fused toner image and passing the substrate bearing the fused toner image through a cooling zone to produce a cooled substrate, which is thereafter passed to a release zone where it is released to produce the substrate bearing the toner image.

The present invention is directed to an improved cooler for use between the fusing zone and the release zone to cool the fuser belt.

The present invention also relates to a system wherein a high efficiency cooling apparatus is used in combination with a high efficiency heating system to cool the fuser belt moving from the fuser roller toward the release roller and heat the fuser belt moving from the release roller toward the fuser roller.

BACKGROUND OF THE INVENTION

Various methods are known for fusing toner particle images on substrates. In conventional fusing systems, one or both of a fuser roller and a pressure roller may be heated and are somewhat compliant to create a wide nip to allow sufficient heating area. Such conventional fusing systems typically provide gloss levels less than about 20 at a 20° measurement. Furthermore, the wide nip prevents obtaining sufficiently high pressure to remove the image relief in these materials.

Finishing color images containing fusible toner particles has been attempted in typical fusing systems. In these fusing systems, as noted above, typically the gloss is relatively low. As a result, systems for fusing colored images using methods and apparatus that result in fusing the black images to the substrate do not provide the desired gloss. Alternate methods have been used to produce enhanced gloss images by fusing the toner particle images and thereafter passing the substrate bearing the fused toner image to a cooling zone and then passing the cooled substrate bearing the fused toner image to a release zone where the cooled substrate bearing an enhanced gloss image is released.

Typically the cooling has been achieved by the use of a cooling device which has an air inlet with a plurality of downwardly directed small air inlets which are positioned above the fuser belt between the fuser roller and a release roller so that as the belt passes beneath the cooler with the substrates stuck to the bottom of the belt, the cooling air is blown downwardly onto the upper surface of the fuser belt to cool the belt. Coolers of this type have been widely used but are not efficient since the air blown downwardly toward the belt at most can travel one-half the width of the cooling device to the edge of the belt. As a result the cooling efficiency of the air is relatively low. Since it is desirable that a significant amount of cooling be achieved, improved methods and apparatus for achieving such cooling have been sought.

SUMMARY OF THE INVENTION

The present invention provides a high efficiency cooling device for a belt fuser, the device comprising: a coolant chamber wherein a coolant is passed in heat exchange with a fuser belt; a coolant inlet into a first end of the coolant chamber; and, a coolant outlet from a second end of the coolant chamber, the second end of the coolant chamber being upstream from the first end of the coolant chamber relative to movement of the fuser belt.

The present invention further provides a high efficiency cooling and heating system for use with a belt fuser, the belt fuser including a fusing section having a fuser roller and a pressure roller and a fuser belt around the fuser roller and a release roller, the system comprising: a coolant chamber between the fuser roller and the release roller and downstream from the fuser roller relative to movement of the fuser belt wherein a coolant is passed in heat exchange with the fuser belt; a coolant inlet into a first end of the coolant chamber; a coolant outlet from a second end of the coolant chamber, the second end of the coolant chamber being upstream from the first end of the coolant chamber relative to movement of the fuser belt; a heat exchange chamber between the release roller and the fuser roller and downstream from the release roller relative to movement of the fuser belt wherein a heat exchange fluid is passed in heat exchange with the fuser belt; a heated fluid inlet into a first end of the heat exchange chamber; a fluid outlet from a second end of the heat exchange chamber, the second end of the heat exchange chamber being up-stream from the first end of the heat exchanger relative to movement of the fuser belt; and, a line in fluid communication with the coolant outlet and the heated fluid inlet.

The invention also provides a method for efficient operation of a belt fuser system, the system including a fusing section having a fuser roller and a pressure roller and a fuser belt around the fuser roller and a release roller, the method comprising: passing a coolant fluid in heat exchange with the fuser belt between the fuser roller and the release roller and downstream from the fuser roller relative to movement of the fuser belt to cool the fuser belt and produce a heated fluid; and, passing the heated fluid in heat exchange with the fuser belt between the release roller and the fuser roller and downstream from the release roller relative to the movement of the fuser belt.

DESCRIPTION OF PREFERRED EMBODIMENTS

In the present invention, the same numbers will be used to refer to the same or similar components throughout to the extent consistent with an accurate disclosure. Further, not all components required for the actual fabrication of the devices have been shown since their description is not necessary to a full understanding of the invention. In the description of the heat exchange apparatus, the apparatus is described as a cooling system but it should be understood that the heat exchange apparatus may also be used for heating.

Figure 1:
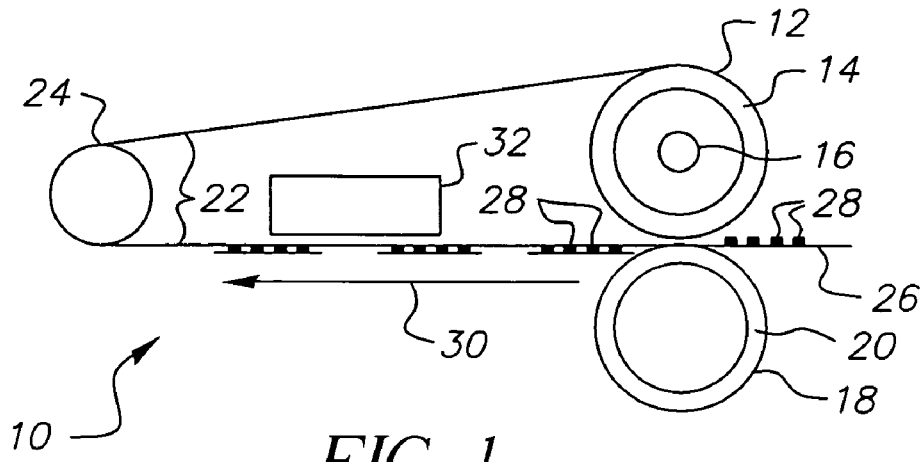
FIG. 1 (PRIOR ART)
FIG. 1 shows a prior art belt fusing system.

In FIG. 1, a typical prior art belt fusing system 10 is shown. The belt fusing system 10 includes a fusing roller 12, which may include a roller coating 14 as known to those skilled in the art. A heater 16 is positioned in fusing roller 12 to heat fusing roller 12. It is well known in the art that alternatively exterior rollers (not shown) could be used to heat fuser roller 12 and the like. A pressure roller 18 is positioned to engage fuser roller 12 and includes a coating 20, also known to those skilled in the art. A belt 22 is positioned around fuser roller 12 and a release roller 24. A sheet 26 bearing images 28 is passed by known means to the fusing nip between fuser roller 12 and pressure roller 18 where the sheet bearing the images is fused and emerges from the fusing nip adhering to the bottom of belt 22. Belt 22 passes by a cooler 32, which is typically an air cooler. The movement of the belt is in a direction shown by an arrow 30. As the fuser belt passes to and around release roller 24, the sheets adhering to the bottom of belt 22, which are now cooled and are less tacky, are released from fuser belt 22 and collected at a downstream location (not shown), as known to those skilled in the art.

Figure 2:
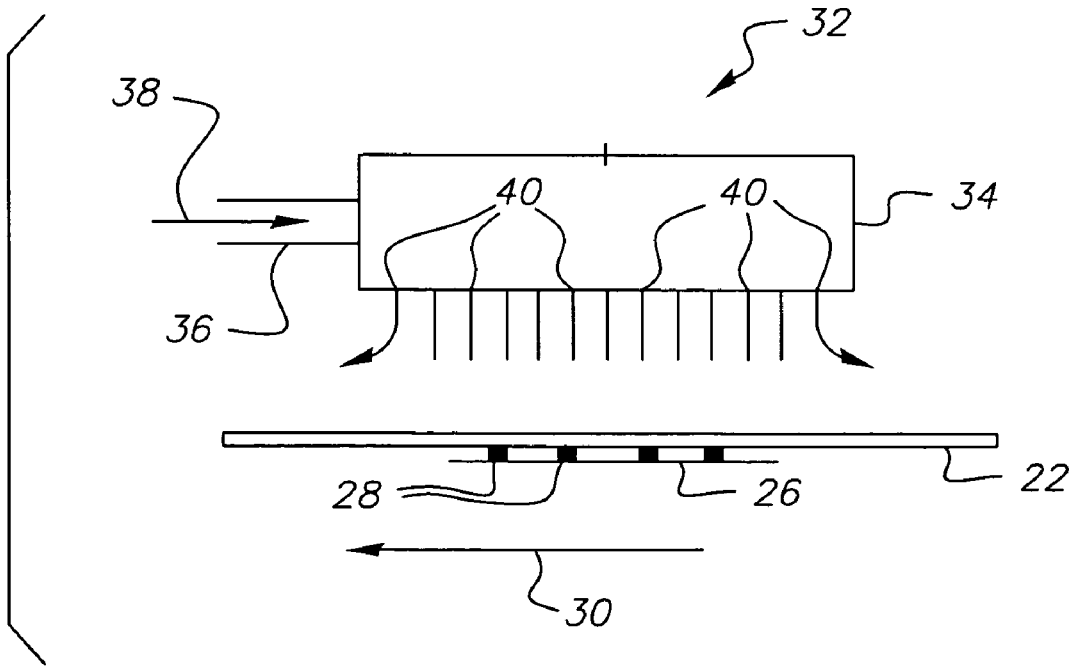
FIG. 2 (PRIOR ART)
FIG. 2 shows a prior art air-cooling system for use in the belt fusing system of FIG. 1.

In FIG. 2 a more detailed schematic showing of air cooler 32 from FIG. 1 is shown. Air cooler 32 includes a chamber 34 into which air is passed through a cooling fluid inlet 36 as shown by an arrow 38. A plurality of cooling fluid outlets 40 are positioned on the bottom of chamber 34 as shown to pass air downwardly toward the top surface of belt 22. As discussed previously, such air cooling systems are relatively inefficient since the air can spill over the edges of the fuser belt relatively quickly after passing from chamber 34 and since in the best case scenario, the air passes no more than half the width of air cooler 32 over the surface of fuser belt 32.

Figure 3:
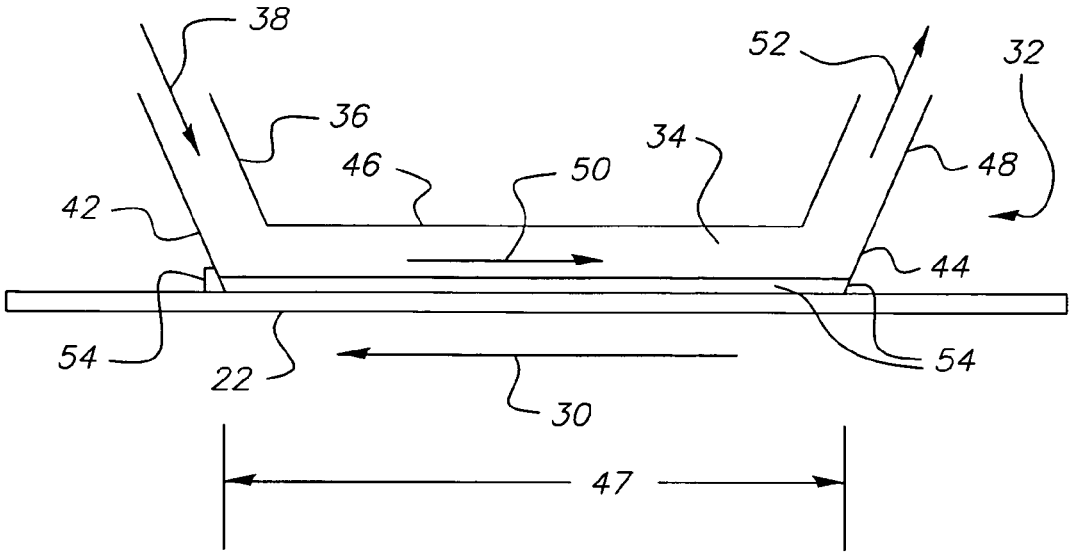
FIG. 3 shows an embodiment of the present high efficiency cooling device of the present invention.

In FIG. 3, an improved cooling apparatus is shown. The improved cooling apparatus includes a first end 42 and a second end 44. A cooling chamber 34 is formed by ends 42 and 44 and a top 46. Air is passed into chamber 34 through a heat exchange fluid inlet 36 as shown by an arrow 38 and passed through chamber 34 as shown by an arrow 50 and recovered via a heat exchange fluid outlet 48 as shown by an arrow 52. In this embodiment, the cooling fluid, which will be discussed as air but could be any other suitable heat exchange gas useful for either heating or cooling, is passed into the cooling chamber 34 in direct contact with the top of fuser belt 22. The air is maintained in chamber 34 by felt or other suitable seals 54 positioned around the bottom of chamber 34 to prevent the escape of air around the bottom of chamber 34.

In this embodiment a length 47 of chamber 34 can be much greater than the width of the air cooler described in FIG. 2. Accordingly the air or other heat exchange medium may be kept in contact with the top of the fuser belt for a greater time than by the prior art methods. Since it is desirable in many instances to cool the top of the fuser belt from about 150 to 160° C. to a temperature from about 70 to about 80° C., it is desirable in many instances to maintain the cooling gas in contact with the fuser belt for a longer period of time. Further, while seals 54 have been described to be of felt, they can be of any suitably resilient material which is stable at the temperatures discussed. Many such materials are known to those skilled in the art.

Figure 4:
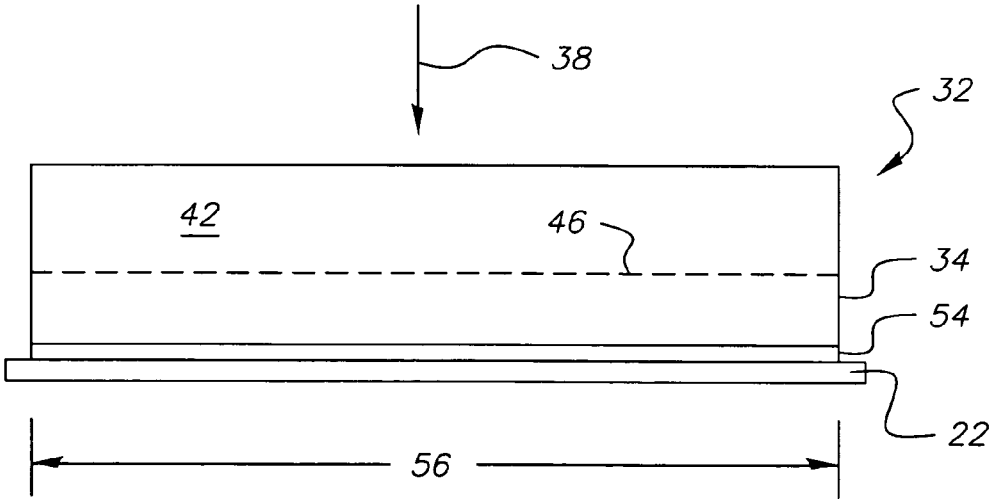
FIG. 4 is a an end view of the apparatus shown in FIG. 3.

In FIG. 4, an end view of the device shown in FIG. 3 is shown. Clearly the width 56 of the chamber 34 can be nearly as wide as the top of the fuser belt 22. This permits the air to uniformly contact the top of fuser belt 22. The air inlet is shown as an inlet slot of substantially the same width as chamber 34 with the air being injected as shown by an arrow 38. It will be understood that air or other cooling gas can be injected through an inlet of any suitable configuration, which is effective to uniformly distribute the cooling air over the surface of fuser belt 22.

Figure 5:
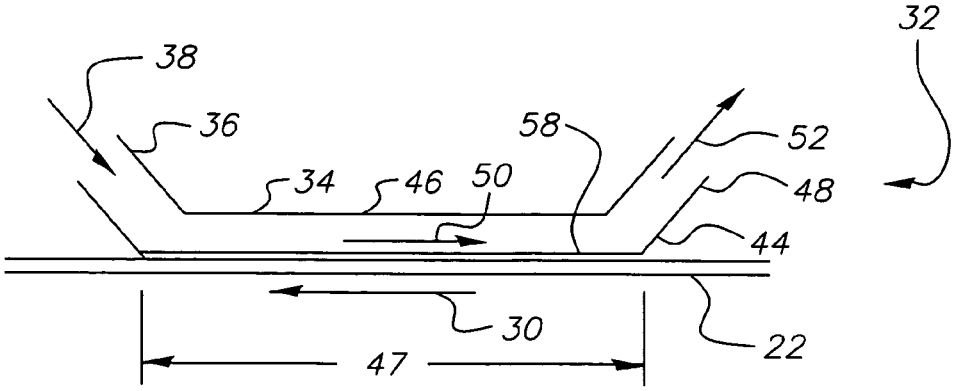
FIGS. 5, 6, 7, 8 and 9 are schematic diagrams of alternate embodiments of the cooling device of the present invention.

In FIG. 5, an alternate embodiment is shown wherein chamber 34 includes a bottom 58, which is in heat exchange contact with the top of fuser belt 22. The term "heat exchange contact" may refer to actual contact or sufficiently close proximity between the bottom 58 of chamber 54 and the top of fuser belt 22 so that intimate heat exchange is accomplished. By both the embodiments shown in FIGS. 3 and 5, it will be noted that the cooling media is recovered and may be passed from the equipment or passed to use for other purposes. This obviates a major disadvantage of the previously used systems which result in a substantial air flow in the vicinity of the air cooler which may result in cooling surfaces which are desirably maintained at high temperatures, such as the surface of the fuser roller and the like.

Figure 6:
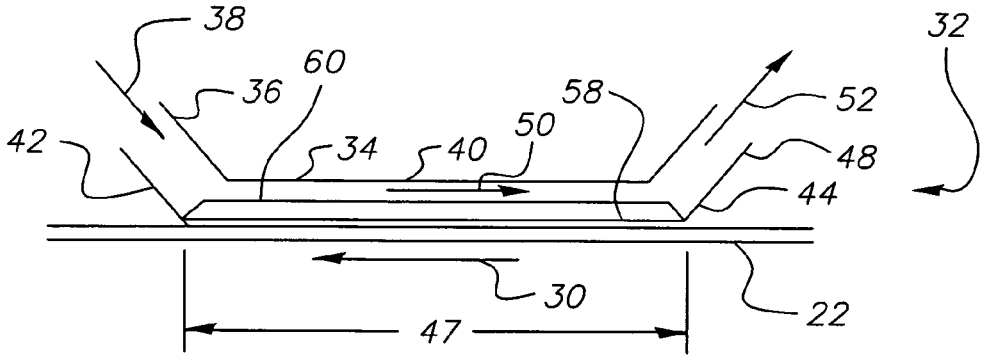

In FIG. 6, an alternate embodiment of the apparatus shown in FIG. 5 is shown. In this embodiment, fins 60 are used on the bottom of chamber 34 to result in enhanced heat exchange.

Figure 7:
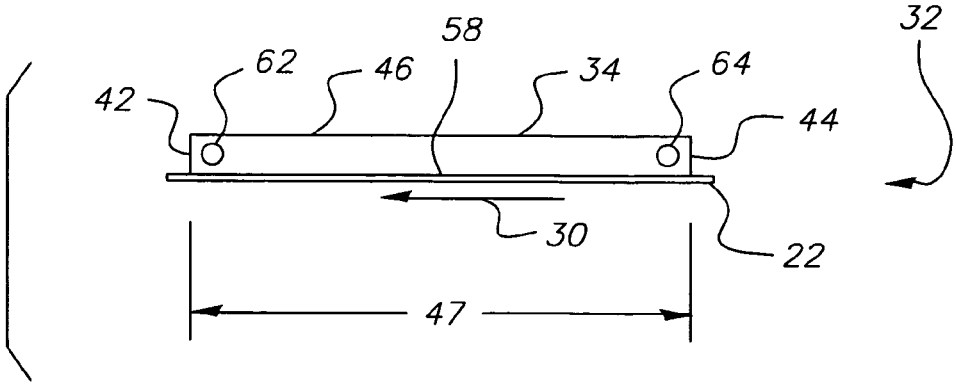
Figure 8:
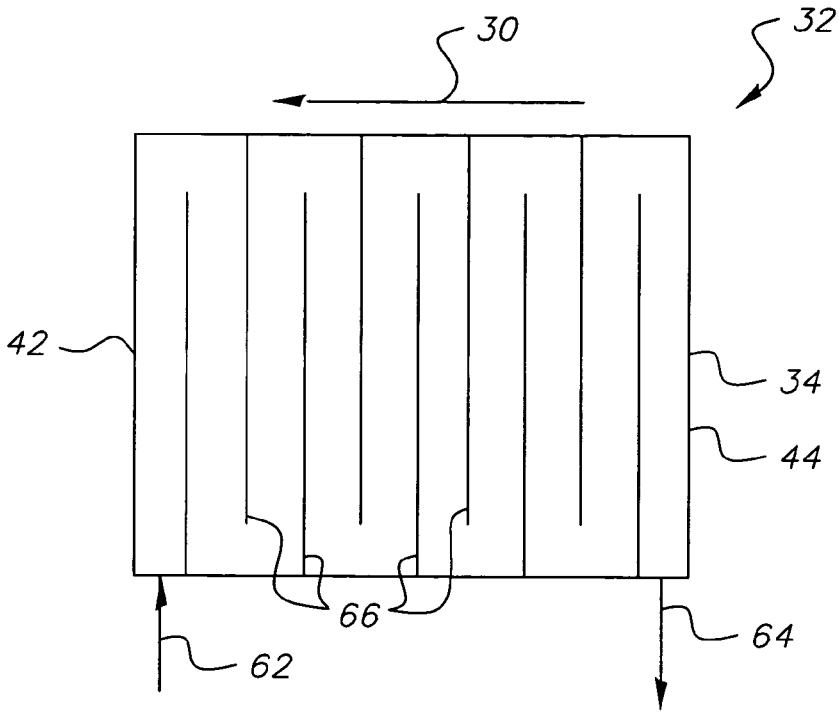

In FIG. 7, an alternate embodiment is shown. In this embodiment, a cooling fluid is injected into chamber 34 via a cooling fluid inlet 62 and recovered by a coolant fluid outlet 64. In this embodiment as further shown in FIG. 8, a plurality of dividers 66 are positioned to cause the cooling fluid to flow in a circuitous path through cooler 32. In this embodiment, chamber 34 may or may not have a bottom. If no bottom is present, then a seal such as a felt seal as shown in FIG. 3 may be used. In these instances, the cooling fluid, which is desirably a gas, is passed through the circuitous path to cool the top of the fuser belt by direct contact of the cooling gas with the top of the fuser belt. Alternatively a bottom may be provided in chamber 34 so that the cooling is through the bottom of chamber 34.

Figure 9:
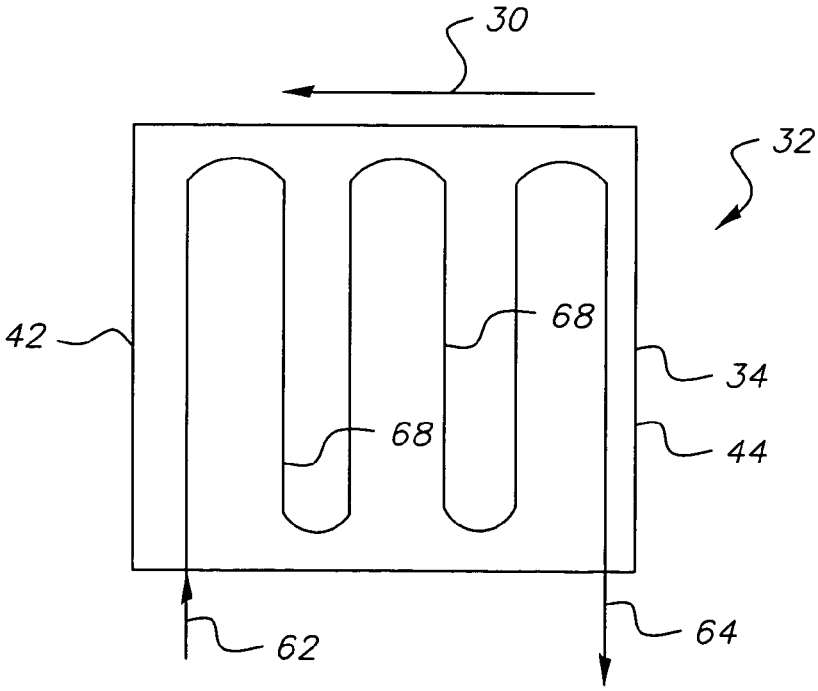

In FIG. 9, an alternate embodiment is shown wherein a plurality of coils 68 is provided in chamber 34. In this embodiment liquid can be used as well as gas as a coolant. In this embodiment there may or may not be a bottom on chamber 34. The cooling achieved in chamber 34 may be achieved by simply passing a coolant through the coils or the coils may be formed as the part of bottom 58 of chamber 34 and the like. In any event, effective cooling is achieved.

Figure 10:
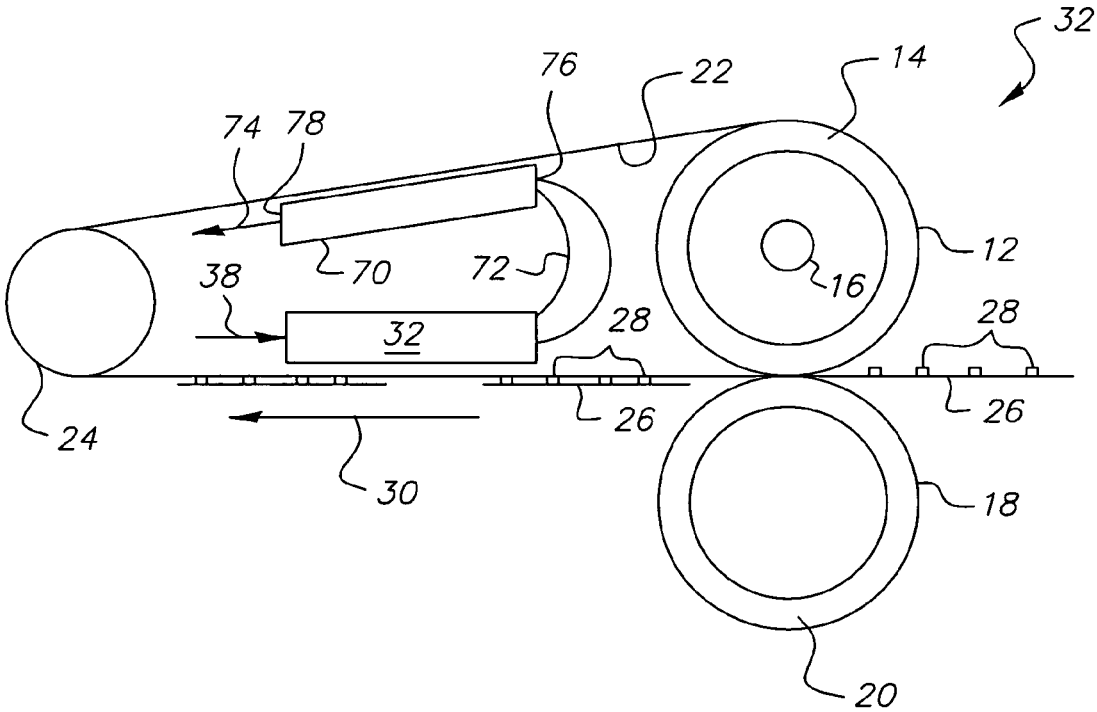
FIG. 10 is a schematic diagram of the system of the present invention showing the use of the improved heat exchange devices of the present invention in use to cool the fuser belt between the fuser roller and a release roller and heat the fuser belt between the release roller and the fuser roller.

In FIG. 10, an embodiment of a system for cooling the fuser belt between fuser roller 12 and release roller 24 is shown. This embodiment also includes a system for heating the fuser belt between release roller 24 and fuser roller 12. All references to the positioning of elements upstream or downstream from other elements are based upon the motion of the fuser belt 22. The movement of fuser belt 22 beneath air cooler 32 is downstream of fuser roller 12 and upstream of release roller 24. Similarly the use of a heater between release roller 24 and release roller 12 positions the heater downstream from release roller 24 and upstream with respect to fuser roller 12.

Any of the embodiments discussed above may be used as an air-cooling or a heating and cooling apparatus. As noted, in at least one embodiment, liquid may also be used as a coolant in the cooling system although the system will be discussed with reference to a gas coolant and a gas heating fluid.

The heated gas recovered from the cooler is passed via a transfer line 72 to a heater 70 where it heats fuser belt 22 between release roller 24 and fuser roller 12. The heating fluid is introduced via an inlet into a first end 76 of heater 70 and discharged through an outlet 74 at second end 78 of heater 70. First end 76 is downstream from second end 78. Desirably, the fuser belt is reheated upstream from fuser roller 12 and at fuser roller 12 to reach a suitable temperature to fuse images 28 on substrate 26 at the nip between fuser roller 12 and pressure roller 18. The discharged heat exchange fluid may be discarded by any suitable means or recycled as a coolant.

Desirably, the heating of fuser belt 22 by heater 70 is at least from about 20 to about 30° C. This is a substantial heat recovery and reduces the heat load on the heater for fuser roller 12 and results in better fusing of the substrates passed through the fusing nip.

The air cooler has been discussed above by reference to the use of air as a gas, although in some embodiments, as clearly disclosed, liquids could be used. Suitable liquids are water or any other desirable heat exchange fluid. Similarly, gases other than air could be used if desired. Preferably air and water are used since both are economical, readily available and readily disposed of after passing through the system.

Accordingly, the apparatus of the present invention is effective to carry out a method for cooling a fuser belt at a desired point and reheating the fuser belt at a second downstream point. The method comprises passing a coolant fluid in heat exchange with the fuser belt between the fuser roller and the release roller and downstream from the fuser roller relative to movement of the fuser belt to cool the fuser belt and produce a heated fluid and passing the heated fluid in heat exchange with the fuser belt between the release roller and the fuser roller and downstream from the release roller relative to the movement of the fuser belt.

In some instances the heat exchange fluid may be in direct contact with the fuser belt and in those instances it is desirable that a gas heat exchange fluid be used. In other instances the heat exchange fluid is not in contact with the fuser belt but is in contact with the chamber, which is in heat exchange contact with the fuser belt.

Further, additional configurations of belt fusers may be suitable for use in the present invention. In such systems, the same steps are accomplished in substantially the same sequence and the heating and cooling may be accomplished by the use of the heat exchange apparatus disclosed in the present invention. In many instances, only cooling may be used but in those instances the increased efficiency achieved by the cooling apparatus of the present invention is considered to be a significant improvement.

As also noted previously, the heat exchange apparatus disclosed may be used for cooling or heating and cooling.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A high efficiency cooling device for a belt fuser, the device comprising:

a) a coolant chamber wherein a coolant is passed in heat exchange with the fuser belt;

b) a coolant inlet into a first end of the coolant chamber; and c) a coolant outlet from a second end of the coolant chamber, the second end of the coolant chamber being upstream from the first end of the coolant chamber relative to movement of the fuser belt.

2. The device of claim 1, wherein the coolant is contained in the coolant chamber during heat exchange with the fuser belt and is recovered through the coolant outlet.

3. The device of claim 2, wherein the coolant is contained in the coolant chamber and in direct heat exchange contact with he fuser belt during heat exchange with the fuser belt.

4. The device of claim 3, wherein the coolant is in direct heat exchange contact for a selected distance.

5. The device of claim 2, wherein the coolant chamber includes a coolant chamber bottom positioned in heat exchange relationship to the fuser belt, the coolant is contained in the coolant chamber in heat exchange contact with the coolant chamber bottom.

6. The device of claim 5, wherein the coolant chamber bottom is in heat exchange relationship with the fuser belt for a selected distance.

7. The device of claim 5, wherein the bottom of the coolant chamber includes heat exchange enhancing protrusions.

8. The device of claim 7, wherein the protrusions are fins.

9. The device of claim 2, wherein the coolant chamber includes partitions and routes the coolant through a circuitous path in the coolant chamber.

10. The device of claim 2, wherein the coolant chamber includes a tubular heat exchange pathway in fluid communication with the coolant inlet and the coolant outlet.

11. A high efficiency cooling and heating system for use with a belt fuser, the belt fuser including a fusing section comprising a fuser roller and a pressure roller and a fuser belt around the fuser roller and a release roller, the system comprising:

a) a coolant chamber between the fuser roller and the release roller and downstream from the fuser roller relative to movement of the fuser belt wherein a coolant is passed in heat exchange with the fuser belt;

b) a coolant inlet into a first end of the coolant chamber;

c) a coolant outlet from a second end of the coolant chamber, the second end of the coolant chamber being upstream from the first end of the coolant chamber relative to movement of the fuser belt;

d) a heat exchange chamber between the release roller and the fuser roller and downstream from the release roller relative to movement of the fuser belt wherein a heat exchange fluid is passed in heat exchange with the fuser belt;

e) a heated fluid inlet into a first end of the heat exchange chamber;

f) a fluid outlet from a second end of the heat exchange chamber, the second end of the heat exchange chamber being up-stream from the first end of the heat exchanger relative to movement of the fuser belt; and g) a line in fluid communication with the coolant outlet and the heated fluid inlet.

12. The system of claim 11, wherein the coolant is contained in the coolant chamber and in direct heat exchange with the fuser belt during heat exchange with the fuser belt.

13. The system of claim 11, wherein the heat exchange fluid is contained in the heat exchange chamber and in indirect heat exchange with the fuser belt during heat exchange with the fuser belt.

14. The system of claim 11, wherein the coolant chamber includes a coolant chamber bottom positioned in heat exchange relationship with the fuser belt and the coolant is contained in the coolant chamber in heat exchange contact with the coolant chamber bottom.

15. The system of claim 11, wherein the coolant chamber includes the heat exchange fluid positioned in heat exchange relationship with the heat exchange chamber.

16. The system of claim 11, wherein at least one of the coolant chamber and the heat exchange chamber includes a bottom positioned in heat exchange relationship with the fuser belt and wherein the bottom includes heat transfer enhancing protrusions.

17. The system of claim 11, wherein at least one of the coolant chamber and the heat exchange chamber include partitions for routing the coolant or the heat exchange fluid through a circuitous path.

18. A method for efficient operation of a belt fuser system, the system including a fusing section comprising a fuser roller and a pressure roller and a fuser belt around the fuser roller and a release roller, the method comprising:

a) passing a coolant fluid in heat exchange with the fuser belt between the fuser roller and the release roller and downstream from the fuser roller relative to movement of the fuser belt to cool the fuser belt and produce a heated fluid; and b) passing the heated fluid in heat exchange with the fuser belt between the release roller and the fuser roller and downstream from the release roller relative to the movement of the fuser belt.

19. The method of claim 18, wherein at least one of the coolant fluid and the heated fluid is passed in direct heat exchange contact with the fuser belt.

20. The method of claim 19, wherein at least one of the coolant and the heated fluid is passed in indirect heat exchange contact with the fuser belt.

21. A high efficiency heating device for a belt fuser, the device comprising:

a) a heat exchange chamber wherein a heat exchange fluid is passed in heat exchange with the fuser belt;

b) a heat exchange fluid inlet into a first end of the heat exchange chamber; and c) a heat exchange fluid outlet from a second end of the heat exchange chamber, the second end of the heat exchange chamber being upstream from the first end of the coolant chamber relative to movement of the fuser belt.

* * * * *